US006715412B2

(12) United States Patent
Chiba et al.

(10) Patent No.: US 6,715,412 B2
(45) Date of Patent: Apr. 6, 2004

(54) PRINTER

(75) Inventors: Keiichi Chiba, Iwanuma (JP); Hironobu Takasawa, Watari-gun (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 30 days.

(21) Appl. No.: 10/118,090

(22) Filed: Apr. 9, 2002

(65) Prior Publication Data

US 2002/0112620 A1 Aug. 22, 2002

Related U.S. Application Data

(62) Division of application No. 09/532,055, filed on Mar. 21, 2000, now Pat. No. 6,382,094.

(30) Foreign Application Priority Data

Jun. 30, 1999 (JP) ..... 11-185285
Jun. 30, 1999 (JP) ..... 11-185435
Jan. 31, 2000 (JP) ..... 2000-022335

(51) Int. Cl.[7] ..... B41F 15/04

(52) U.S. Cl. ..... 101/115; 101/116; 101/248

(58) Field of Search ..... 101/115, 116, 101/216, 247, 248, 181

(56) References Cited

U.S. PATENT DOCUMENTS 4,157,652 A * 6/1979 Mathes et al. ..... 68/22 B
6,038,968 A * 3/2000 Hara et al. ..... 101/116
6,109,176 A * 8/2000 Fujio et al. ..... 101/216
6,314,877 B1 * 11/2001 Takasawa ..... 101/115
6,382,094 B1 5/2002 Chiba et al.

FOREIGN PATENT DOCUMENTS

JP 4-329175 11/1992
JP 7-017121 1/1995
JP 11-129600 5/1999

* cited by examiner

*Primary Examiner*—Ren Yan
(74) *Attorney, Agent, or Firm*—Oblon, Spivak, McClelland, Maier & Neustadt, P.C.

(57) ABSTRACT

A printer capable of printing a multicolor image with a single pass of a paper or similar recording medium includes a plurality of print drums. Drum drive gears each are mounted on a particular print drum such that the print drum is replaceable. The print drums are interlocked to each other by rotatable members including relay gears meshing with the drum drive gears, timing pulleys fixed to the relay gears, a timing belt, and pulleys for adjustment. Each rotatable member has teeth the number of which is selected such that the number of rotations of the rotatable member to occur in a single period of the print drums is an integral multiple of the number of rotations of the print drums.

2 Claims, 16 Drawing Sheets

PRINTER

BACKGROUND OF THE INVENTION

The present invention relates to a stencil printer or similar printer and more particularly to a printer capable of printing a multicolor image by conveying a paper or similar recording medium via consecutive print drums only once.

It is a common practice with a stencil printer to arrange a plurality of print drums each storing ink of particular color in the direction of paper conveyance. While a paper is conveyed from the upstream side toward the downstream side of the printer once, images of different colors are sequentially transferred from the print drums to the paper one above the other. As a result, a multicolor image is printed on the paper by a single pass of the paper. Such a single pass system is far more efficient than a system requiring a print drum to be replaced color by color and requiring a paper to be repeatedly fed. However, the single pass system has an offset ghost problem ascribable to a short distance between consecutive print positions.

Specifically, in the single pass system, a paper carrying an image transferred from an upstream print drum, e.g., a first-color print drum is brought to a downstream print drum, e.g., a second-color print drum without ink forming the image being dried. As a result, the ink is transferred from the paper to a master wrapped around the downstream drum and therefore from the master to the next paper.

The transfer of wet ink from the paper to the master wrapped around the downstream print drum is not critical. However, the ink transferred from the paper to the above master is again transferred to the next paper carrying an image of a first color transferred from the upstream print drum (so-called retransfer). The retransfer does not degrade image quality if the ink can be retransferred to the next paper in accurate register with the image of the first color printed on the paper. The retransferred ink, however, forms an offset ghost and critically degrades image quality if deviated from the image carried on the next paper. For example, for a given deviation, the offset ghost renders thick lines blurred and thin lines doubled.

While the retransfer cannot be obviated in the single pass, multicolor printer, the offset ghost ascribable to the deviation of a retransfer position can be highly accurately controlled if the upstream and downstream print drums rotate in accurate synchronism with each other and if papers are conveyed with high accuracy.

To control the offset ghost, it has been customary to drive the upstream and downstream print drums by interlocking them to each other. Japanese Patent Laid-Open Publication No. 4-329175, for example, teaches an interlocked drive system in which the shafts of the print drums are interconnected by a plurality of gears. Japanese Patent Laid-Open Publication No. 7-17121 proposes another interlocked drive system using timing pulleys and a timing belt.

However, the conventional interlocked drive system, whether it be the gear scheme or the timing belt scheme, has a problem that the gears, timing belt and other rotatable members interlocking the print drums are more or less eccentric for machining reasons and therefore vary their speeds during one rotation. As for the gear scheme, high rigidity available with a gear train can reduce the deviation of the offset ghost if high precision gears are used. However, a plurality of high precision gears increase the production cost of the printer. The printer with the timing belt scheme is low cost because use can be made of inexpensive timing pulleys that can be produced by, e.g., injection molding on a quantity basis. However, the timing belt and timing pulleys involve eccentricity and aggravate the deviation of the offset ghost.

Technologies relating to the present invention are also disclosed in, e.g., Japanese Patent Laid-Open Publication No. 11-129600.

SUMMARY OF THE INVENTION

It is therefore an object of the present invention to provide a printer capable of reducing the deviation of an offset ghost without increasing the cost.

In accordance with the present invention, a printer includes a plurality of print drums spaced from each other in a direction in which a recording medium is conveyed. A plurality of rotatable members interlock the print drums with respect to drive. The print drums and rotatable members are so arranged as to prevent an upstream and a downstream print drum rotating synchronously to each other from being brought out of synchronism when the recording medium arrives at the downstream print drum.

Also, in accordance with the present invention, a printer includes a plurality of print drums spaced in a direction in which a recording medium is conveyed. A plurality of toothed drum drive pulleys each are mounted on a particular print drum. A timing belt is passed over the drum drive pulleys to thereby inter lock the print drums with respect to drive. A phase adjusting device includes adjustment pulleys meshing with the timing belt, and displaces the adjustment pulleys for adjusting a phase between the print drums. The adjustment pulleys each have a number of teeth which is 1/integer of the number of teeth of each drum drive pulley.

Further, in accordance with the present invention, a printer includes a plurality of print drums spaced in a direction in which a recording medium is conveyed. A plurality of toothed drum drive pulleys each are mounted on a particular print drum. A timing belt is passed over the drum drive pulleys to thereby interlock the print drums with respect to drive. A phase adjusting device includes adjustment pulleys meshing with the timing belt, and displaces the adjustment pulleys for adjusting a phase between the print drums. Steer pulleys are fixed in place between the drum drive pulleys and the adjustment pulleys and contact the rear of the timing belt for steering it. The steer pulleys each have a pitch circle diameter which is 1/integer of the pitch circle diameter of each drive pulley.

Moreover, in accordance with the present invention, a printer includes a plurality of print drums spaced in a direction in which a recording medium is conveyed. A plurality of toothed drum drive pulleys each are mounted on a particular print drum. A timing belt is passed over the drum drive pulleys to thereby interlock the print drums with respect to drive. A phase adjusting device includes adjustment pulleys contacting the rear of the timing belt between the print drums, and displaces the adjustment pulleys for adjusting a phase between the print drums. The adjustment pulleys each have a pitch circle diameter which is 1/integer of the pitch circle diameter of each drum drive pulley.

In addition, in accordance with the present invention, a printer includes a plurality of print drums spaced in a direction in which a recording medium is conveyed. A plurality of toothed drum drive pulleys each are mounted on a particular print drum. A timing belt is passed over the drum drive pulleys to thereby interlock the print drums with respect to drive. A phase adjusting device includes adjustment pulleys contacting the rear of the timing belt between the print drums, and displaces the adjustment pulleys for adjusting a phase between the print drums. Steer pulleys are fixed in place between the drum drive pulleys and the adjustment pulleys and meshing with the timing belt for steering it. The steer pulleys each have a number of teeth which is 1/integer of the number of teeth of each drive pulley.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
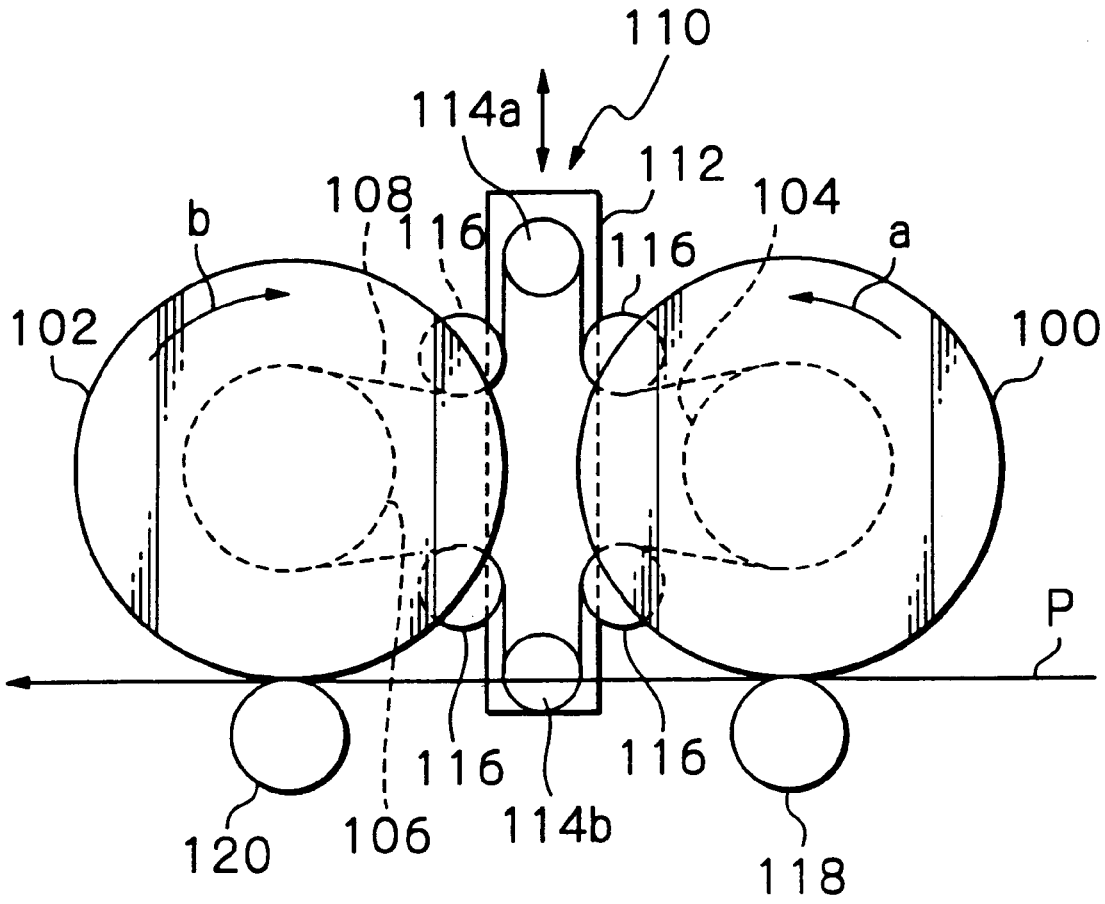
Fig. 1 PRIOR ART
FIG. 1 is a front view showing a conventional stencil printer.

To better understand the present invention, reference will be made to a conventional single pass, multicolor printer of the type connecting the shafts of a plurality of print drums with timing pulleys and a timing belt, shown in FIG. 1. As shown, the printer includes two print drums 100 and 102 respectively located at the upstream side and downstream side in a direction in which a paper or similar recording medium P is conveyed (direction of paper conveyance hereinafter). Toothed drum drive pulleys or timing pulleys 104 and 106 are respectively mounted on the print drums 100 and 102. A timing belt 108 is passed over the drum drive pulleys 104 and 106. In this condition, the print drums 100 and 102 are driven in interlocked relation to each other.

Phase adjusting means 110 intervenes between the print drums 100 and 102 for adjusting a phase between the print drums 100 and 102, i.e., a deviation between the first and second colors in the direction of paper conveyance or to-and-bottom direction. The phase adjusting means 110 includes a frame 112 movable up and down by being driven by drive means not shown. Toothed adjustment pulleys 114*a* and 114*b* are respectively rotatably mounted on the upper and lower end portions of the frame 112. A timing belt 108 is passed over the adjustment pulleys 114*a* and 114*b*. Four steer pulleys 116 are fixed in place between the adjustment pulleys 114*a* and 114*b* and the print drums 100 and 102, as illustrated, so as to steer the timing belt 108. The displacement of the phase adjusting means 110 in the up-and-down direction implements efficient phase adjustment within a short distance. The steer pulleys 116 that contact the rear of the timing belt 108 are implemented by plain pulleys. There are also shown in FIG. 1 press rollers 100 and 102 movable into and out of contact with the print drums 100 and 102, respectively.

When the frame 112 and therefore the adjustment pulleys 114*a* and 114*b* move upward, the print drums 100 and 102 are respectively caused to rotate in directions a and b, i.e., the phases of the print drums 100 and 102 are varied. When the frame 112 is moved downward, the phases of the print drums 100 and 102 are varied in the opposite directions. In this manner, the phase adjusting means is capable of correcting the deviation of an image ascribable to a change in printing speed and is essential with a printer of the type described.

The drum drive pulleys 104 and 106 and adjustment pulleys 114, all of which mesh with the timing belt 108, are more or less eccentric due to limited machining and assembling accuracy. Also, the timing belt 108 itself involves unnegligible eccentricity due to the limited accuracy of its core line. Moreover, considering the presence of the phase adjusting means 110, the irregular thickness of the timing belt 108 over the entire circumference is another eccentricity component due to the steer pulleys 116 contacting the rear of the belt 108.

An offset ghost occurs once for a single rotation of the print drums 100 and 102, i.e., the drum drive pulleys 104 and 106. In this respect, the eccentricity of the drum drive pulleys 104 and 106, if any, does not disturb the synchronous rotation of the print drums 100 and 102. However, as for the adjustment pulleys 114, any eccentricity shifts the phases of the print drums 100 and 102 every time the pulleys 114 rotate or shifts them every time the drum drive pulleys 104 and 106 rotate when combined with the eccentricity of the timing belt 108.

Why the eccentricity of the adjustment pulleys 114*a* and 114*b* bring about an offset ghost will be described with reference to FIGS. 2 and 3. Assume that the ratio of the number of teeth of the drum drive pulleys 104 and 106 to that of the adjustment pulleys 114*a* and 114*b* is 4.3:1, i.e., the former is not an integral multiple of the latter, and that the pulleys 104 and 106 and pulleys 114 are eccentric. Then, the speed of the drum drive pulley 104 and that of the adjustment pulley 114*a* vary, as represented by waveforms in FIG. 2. The other drum drive pulley 106 and the other adjustment pulley 114*b* vary in speed in the same manner as the pulley 104 and pulley 114*a* although not shown specifically.

Figure 2:
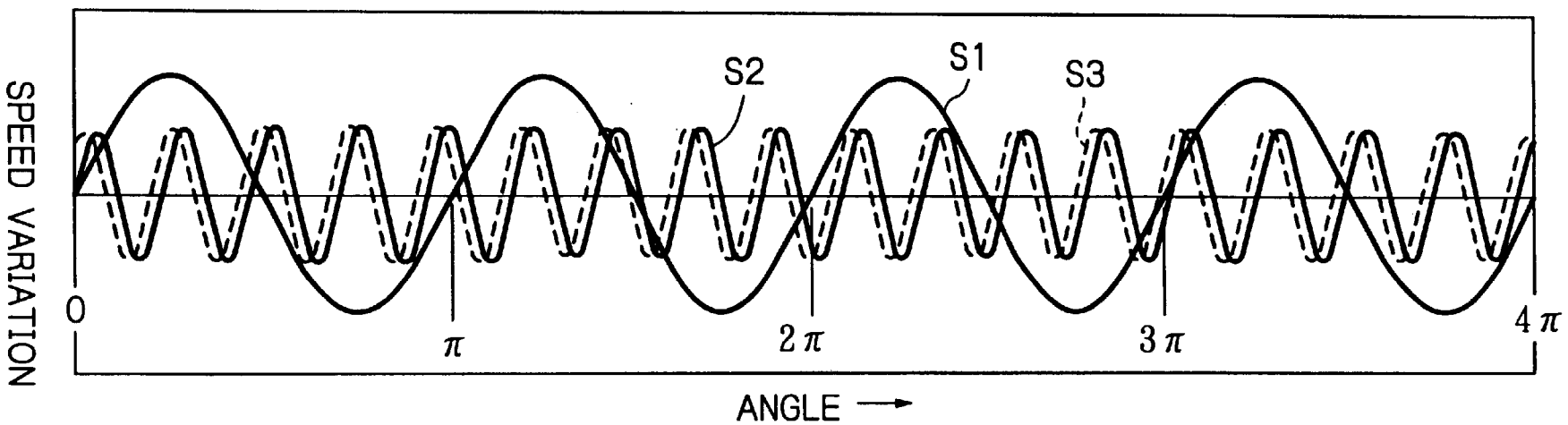
Fig. 2 PRIOR ART
FIG. 2 is a waveform diagram showing speeds varying due to the eccentricity of, e.g., adjustment pulleys included in the conventional printer.

In FIG. 2, a solid waveform S1 indicates the speed variation of the drum drive pulley 104. A solid waveform S2 indicates the speed variation of the adjustment pulley 114*a*; the origin of the waveform is shown as coinciding with the origin of the waveform representative of the speed variation of the drum drive pulley 104 for the sake of illustration. Further, a dashed waveform S3 indicates the speed variation of the adjustment pulley 114*a* occurring when the eccentric position of the pulleys 104 and 114*a* are different from each other. As the waveform S3 indicates, the origin of the waveform of the drum drive pulley 104 and that of the waveform of the adjustment pulley 114*a* are, in many cases, not coincident with each other.

Figure 3:
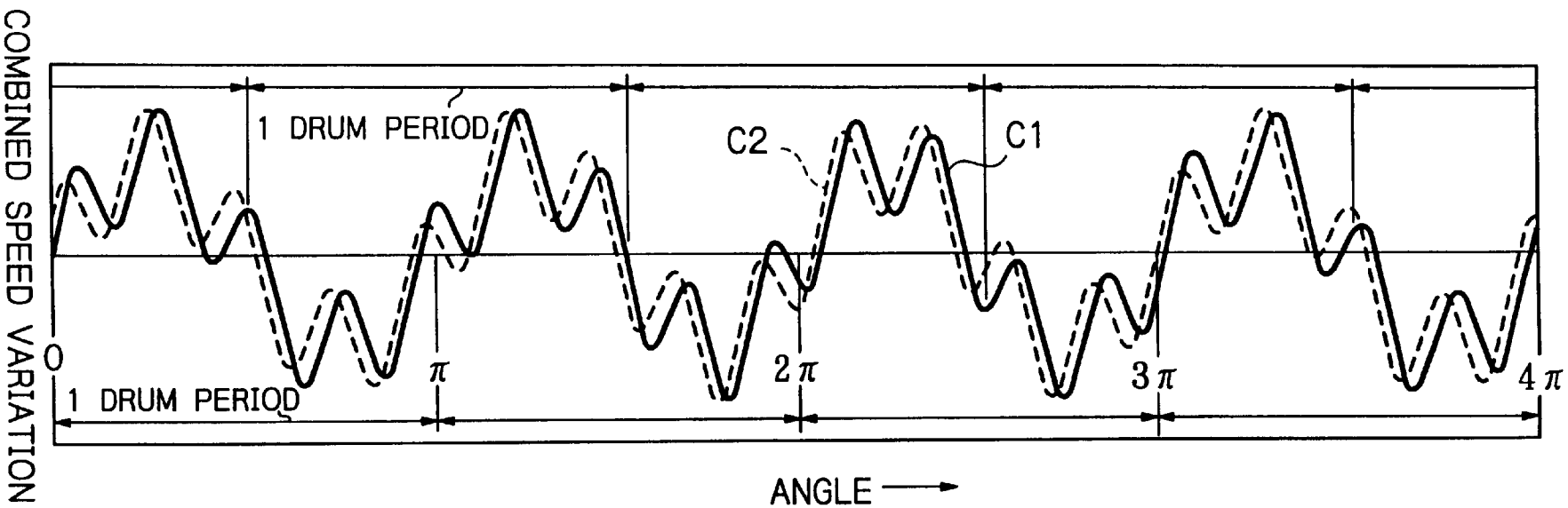
Fig. 3 PRIOR ART
FIG. 3 is a waveform diagram showing the combined variations of the speeds shown in FIG. 2.

FIG. 3 shows a solid waveform C1 representative of the combined speed variation of the waveforms S1 and S2 of FIG. 2, and a dashed waveform C2 representative of the combined speed variation of the waveforms S1 and S3 of FIG. 2. As shown, wherever a drum period may begin, the waveforms S1 and S3 vary every drum period. As a result, the print drums 100 and 102 are deviated from each other in a particular manner in each period, causing an offset ghost to appear.

Figure 4:
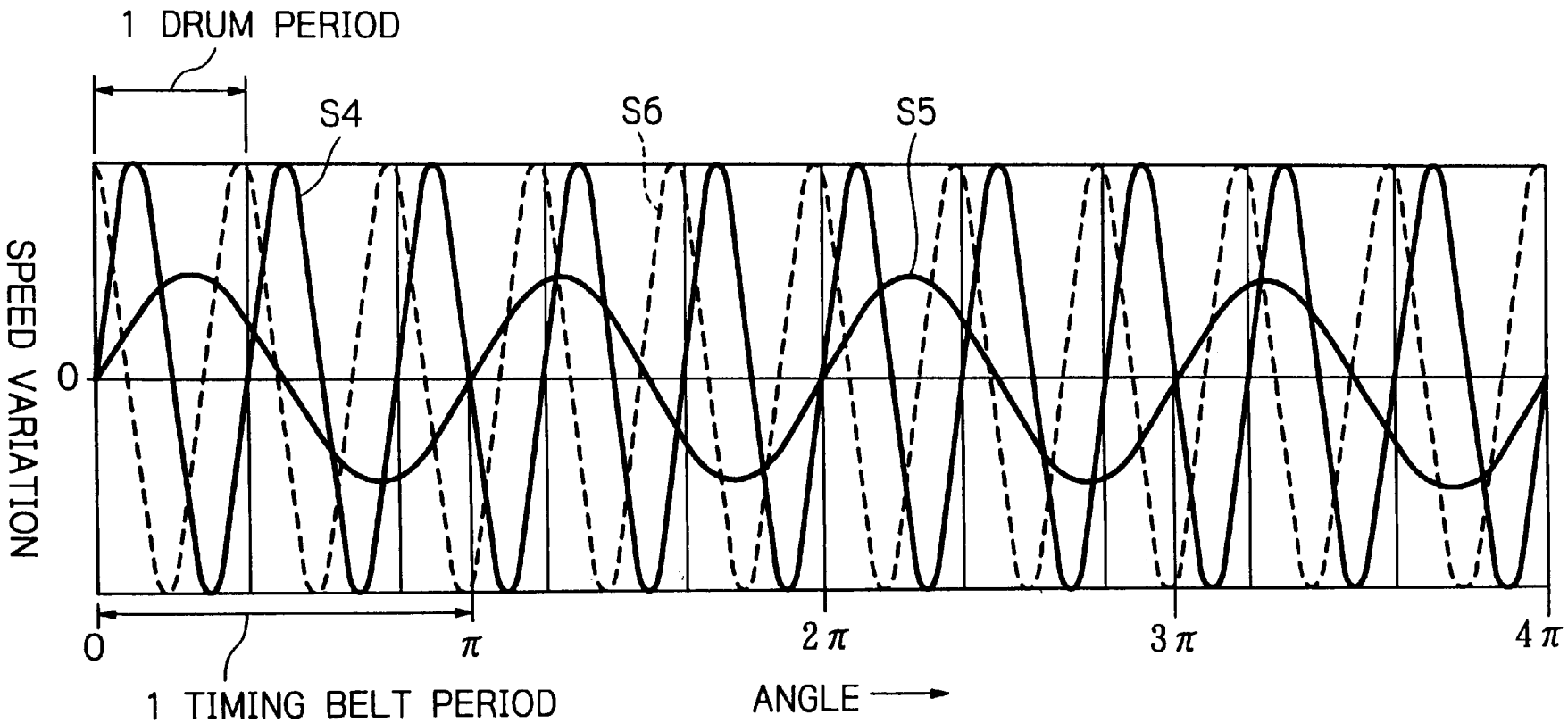
Fig. 4 PRIOR ART
FIG. 4 is a waveform diagram showing speeds varying due to the eccentricity of drum drive pulleys and a timing belt also included in the conventional printer.
Figure 5:
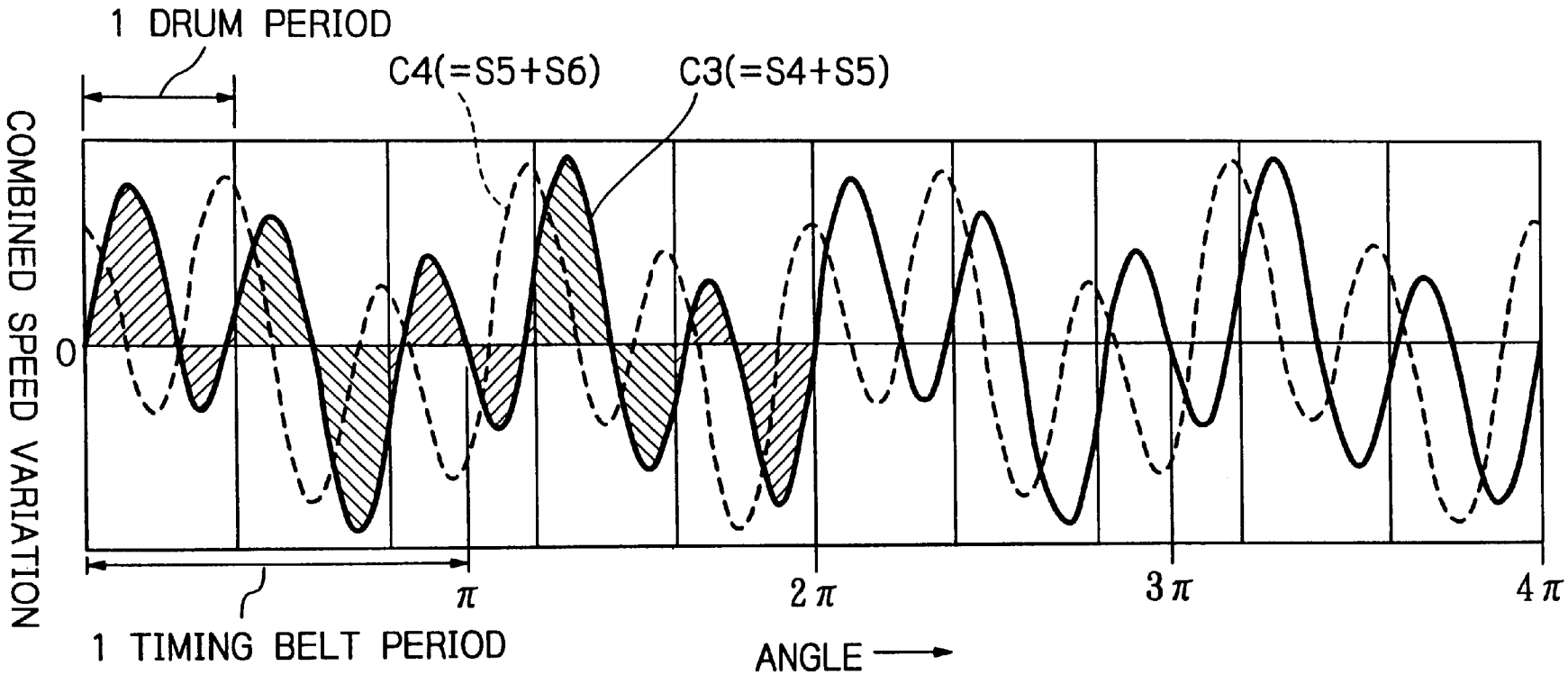
Fig. 5 PRIOR ART
FIG. 5 is a waveform diagram showing the combined variations of the speeds shown in FIG. 4.
Figure 6:
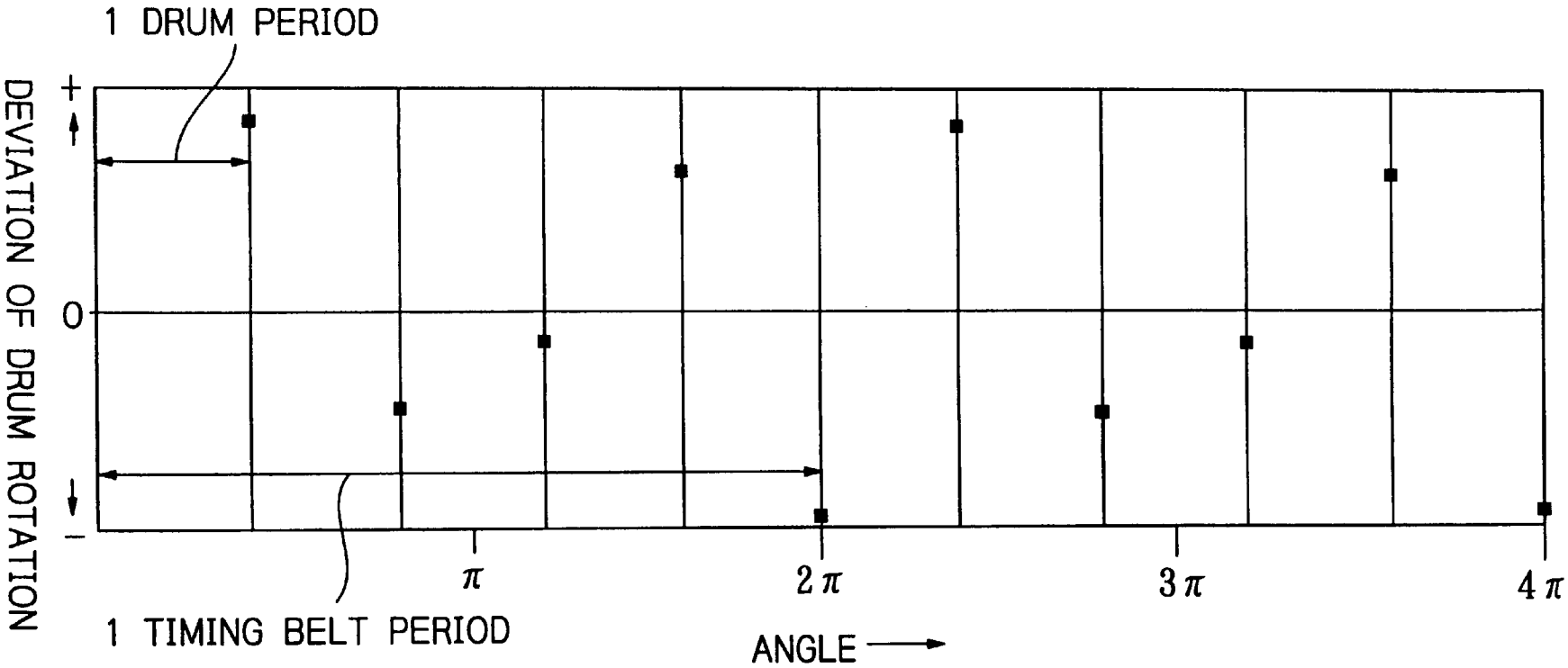
Fig. 6 PRIOR ART
FIG. 6 is a plot showing the deviations of rotation of a print drum also included in the conventional printer and determined by calculating period-by-period areas based on the waveforms of FIG. 5.

Reference will be made to FIGS. 4 through 6 for describing an offset ghost ascribable to the eccentricity of the timing belt 108. Assume the ratio of the number of teeth of the drum drive pulleys 104 and 106 to that of the timing belt 108 is 1:2.5, i.e., the latter is not an integral multiple of the former, and that the drum drive pulleys 104 and 106 and timing belt 108 are eccentric. Then, the speed of the drum drive pulley 106 and that of the timing belt 108 vary, as represented by waveforms in FIG. 4. The other drum drive pulley 104 varies in speed in the same manner as the drum drive pulley 106 although not shown specifically.

In FIG. 4, a solid waveform S4 indicates the speed variation of the drum drive pulley 106. A solid waveform S5 indicates the speed variation of the timing belt 108; the origin of the waveform is shown as coinciding with the origin of the waveform representative of the speed variation of the drum drive pulley 106 for the sake of illustration. Further, a dashed waveform S6 indicates the speed variation of the drum drive pulley 106 occur ring when the eccentric position of the pulley 106 and that of the timing belt 108 are different from each other. As the waveform S6 indicates, the origin of the waveform of the drum drive pulley 106 and that of the waveform of the timing belt 108 are, in many cases, not coincident with each other.

FIG. 5 shows a solid waveform C3 representative of the combined speed variation of the waveforms S4 and S5 of FIG. 4, and a dashed waveform C4 representative of the combined speed variation of the waveforms S5 and S6 of FIG. 4. As shown, wherever a drum period may begin, the waveforms S3 and S4 vary in a particular manner in each drum period. In this case, however, the drum drive pulley 106 and timing belt 108 having the gear ratio of 1:2.5 constantly have five periods and two periods, respectively. That is, the identical waveform C3 appears every five periods of the drive pulley 106.

FIG. 6 plots the sums of the areas of the waveform C3, FIG. 5, indicated by hatching for every period of the drum drive pulley 106; the sizes indicate how much the synchronization of the drum drive pulley 106 is deviated. As FIG. 6 indicates, the same deviation of the drum drive pulley 106 occurs every other period of the timing belt 108.

Preferred embodiments of the printer in accordance with the present invention will be described hereinafter.

1st Embodiment

Figure 7:
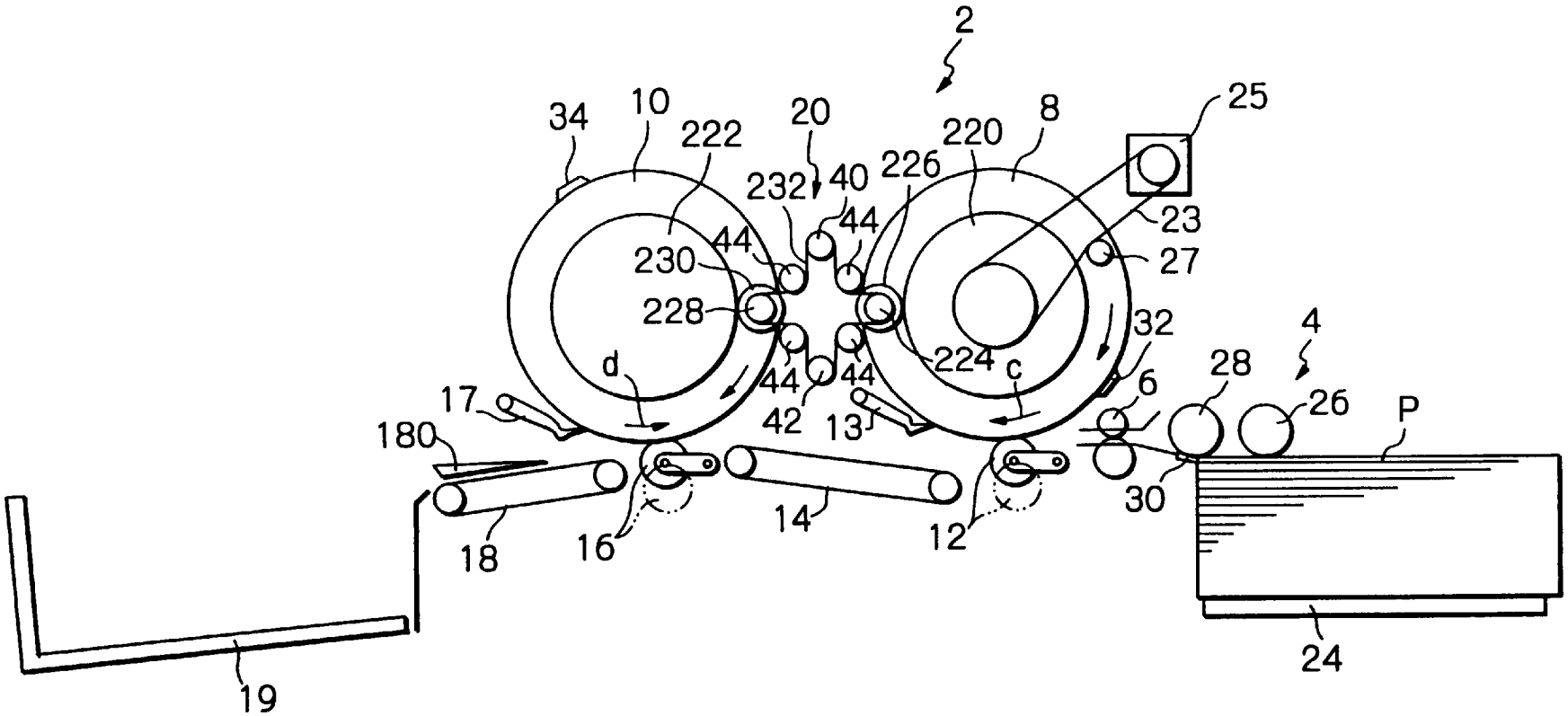
FIG. 7 is a front view showing a first embodiment of the printer in accordance with the present invention.

Referring to FIG. 7, a printer embodying the present invention is shown and implemented as a bicolor stencil printer by way of example. As shown, the printer, generally 2, includes paper feeding means 4 for feeding papers or similar recording media P to a registration roller pair 6 one by one. Two print drums 8 and 10 are spaced from each other in the direction in which the paper P fed from the paper feeding means 4 is conveyed (direction of paper conveyance hereinafter). A press roller or pressing member 12 is movable into and out of contact with the upstream print drum 8 by being driven by a moving mechanism not shown. Separating means 13 separates the paper P carrying an image of a first color from the print drum 8 by sending air. Suction belt type intermediate conveying means 14 conveys the paper P between the print drums 8 and 10. Another press roller or pressing member 16 is movable into and out of contact with the downstream print drum 10 by being driven by a moving mechanism not shown. Separating means 17 separates the paper P carrying an image of a second color transferred from the print drum 8 over the image of the first color by sending air. Outlet conveying means 18 conveys the paper P separated from the print drum 10 to a print tray 19. Phase adjusting means 20 adjusts a phase between the print drums 8 and 10.

Drum drive gears 220 and 222 are respectively mounted on the print drums 8 and 10 such that the print drums 8 and 10 each are replaceable. A relay gear 226, which has a timing pulley 224 integrally therewith, is fixed in place and held in mesh with the drum drive gear 220. Likewise, a relay gear 230 having a timing pulley 228 integrally therewith is fixed in place and held in mesh with the drum drive gear 222 of the print drum 10.

A timing belt 232 is passed over the timing pulleys 224 and 228 with the intermediary of the phase adjusting means 20, so that the print drums 8 and 10 can be synchronously driven in interlocked relation to each other. Specifically, a main motor 25 is drivably connected to the print drum 8 via a main drive belt 23. The rotation of the main motor 25 is transferred to the print drum 10 via the relay gear 226, timing belt 232, and so forth. A pulley 27 applies a preselected degree of tension to the main drive belt 23.

In the paper feeding means 4, a tray 24 is loaded with a stack of papers P and intermittently raised by a motor not shown. A pickup roller 26, a separator roller 28 and separator pad 30 cooperate to feed the top paper P from the tray 24 toward the registration roller pair 6 while separating it from the underlying papers. The registration roller pair 6 corrects, e.g., the skew of the paper P and conveys it toward the print drum 8 at such a timing that the leading edge of the paper P meets the leading edge of an image formed on the print drum 8.

At the above timing, the press roller 12 is pressed against the print drum 8. Ink feeding means arranged within the print drum 8 feeds ink of the first color to the inner periphery of the print drum 8. The press roller 12 therefore causes the ink to penetrate through the print drum 8 and the perforations of a master, not shown, wrapped around the drum 8 to the paper P. As a result, an image of the first color is printed on the paper P. It is to be noted that the press roller 12 is intermittently pressed against the print drum 8 so as not to interfere with a damper 32 mounted on the outer circumference of the drum 8.

The separating means 13 separates the paper P carrying the image of the first color thereon from the print drum 8. The intermediate conveying means 14 conveys the separated paper P while a suction fan, not shown, retains the paper P on the conveying means 14 by suction. The linear velocity of the conveying means 14 is selected to be higher than the linear velocity of the paper P by preselected times. The conveying means 14 conveys the paper P to a nip between the downstream print drum 10 and the press roller 16.

Ink feeding means, not shown, is also arranged within the downstream print drum 10 and feeds ink of a second color to the inner periphery of the drum 10. Therefore, when the press roller 16 is pressed against the print drum 10 with the intermediary of the paper P, it causes the above ink to penetrate through the print drum 10 and a master, not shown, wrapped around the drum 10 to the paper P. Consequently, an image of the second color is printed on the paper P over the image of the first color existing on the paper P. The press roller 16 is intermittently pressed against the print drum 10 so as not to interfere with a clamper 34 mounted on the outer circumference of the drum 10.

The separating means 17 separates the paper P carrying the composite image of the first and second colors thereon from the print drum 10. The outlet conveying means 18 conveys the separated paper P while a suction fan, not shown, retains the paper P on the conveying means 18 by suction. Finally, the paper or print P is driven out to the print tray 19. At this instant, a jump board 180 provides the paper P with an adequate degree of stiffness.

The phase adjusting means 20 includes two adjustment pulleys or timing pulleys 40 and 42. Four steer pulleys 44 are fixed in place between the adjustment pulleys 40 and 42 and the relay gears 226 and 230. The steer pulleys 44 allow phase adjustment based on the up-and-down movement of the phase adjusting means 20 to be efficiently effected within a short distance. In the illustrative embodiment, the steer pulleys 44 serve as tension pulleys as the same time. The drum drive gears 220 and 222, timing pulleys 224 and 228, relay gears 226 and 230, timing belt 232, adjustment pulleys 40 and 42 and steer pulleys 44 are rotatable members inter locking the two print drums 8 and 10 with respect to drive.

Figure 8:
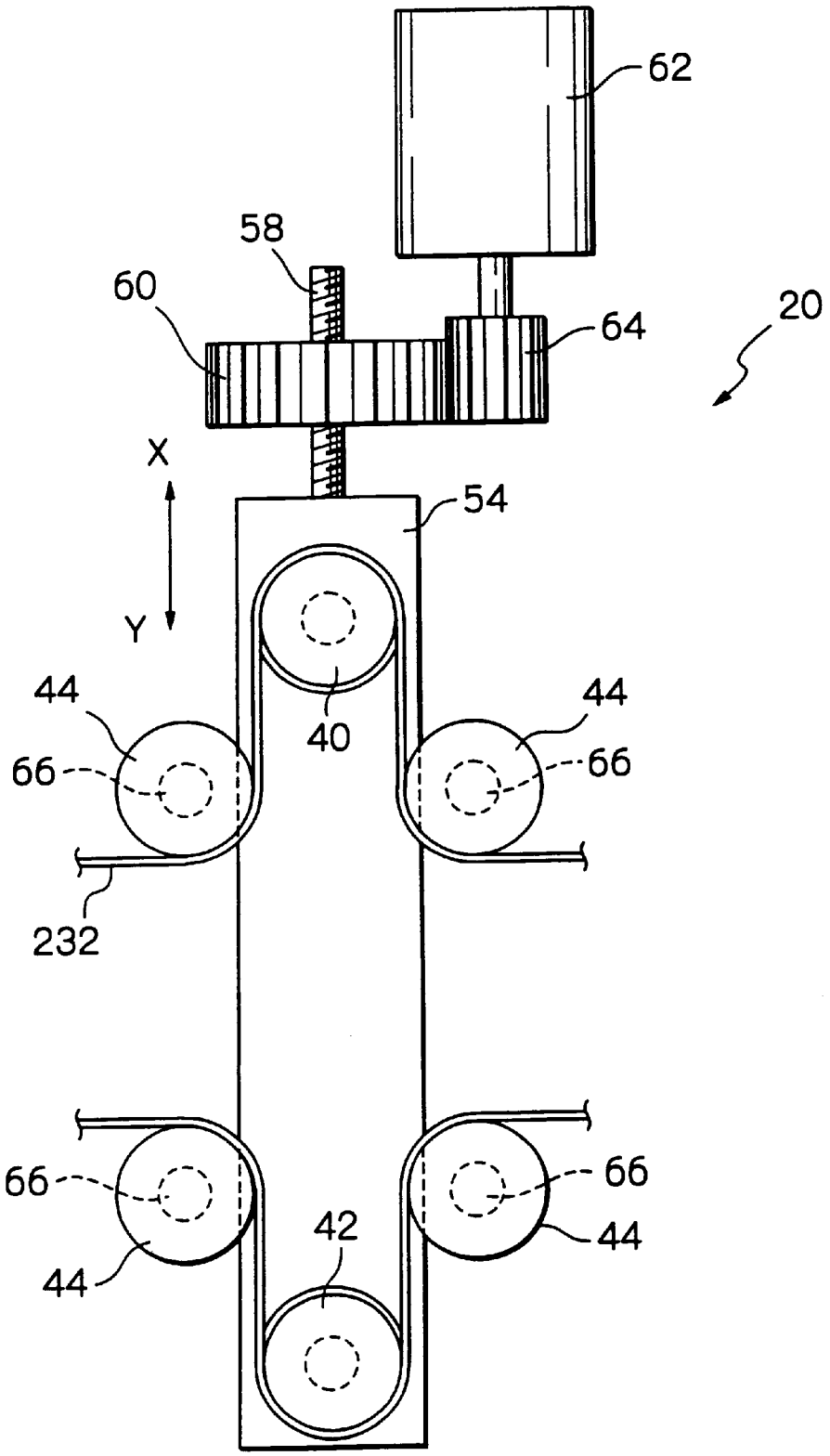
FIG. 8 is a front view of phase adjusting means included in the first embodiment.

As best shown in FIG. 8, the phase adjusting means 20 includes a frame 54 elongate in the up-and-down direction. The adjustment pulleys 40 and 42 are respectively rotatably mounted on the upper and lower end portions of the frame 54. A stationary screw shaft 58 extends upward from the top of the frame 54. A nut gear 60 is held in mesh with the screw shaft 58 and fixed in place by a bracket not shown. A motor 62 has an output shaft on which a drive gear 64 is mounted. The drive gear 64 is held in mesh with the nut gear 60. In this configuration, the motor 62 selectively causes the frame 54 to move upward or downward while being guided by guides, not shown, supported by the side walls of the printer body.

The steer pulleys 44, implemented as plain pulleys, each are rotatably mounted on a respective shaft 66 fixed to the sidewalls of the printer body. The steer pulleys 44 are positioned between the pulleys 40 and 42 and the relay gears 226 and 230 in such a manner as to squeeze the timing belt 232 and held in contact with the rear of the timing belt 232.

When the motor 62 is driven to move the frame 54 upward, as indicated by an arrow X, the frame 54 raises the pulleys 40 and 42 and thereby causes the print drums 8 and 10 to respectively rotate in directions c and d shown in FIG. 7. As a result, the phases of the print drums 8 and 10 are varied to correct color deviation. The motor 62 may be driven in the opposite direction to move the frame 54 downward, as indicated by an arrow Y, thereby adjusting the above phases in the opposite direction.

In the illustrative embodiment, a single period of each of the above rotatable members is selected to be equal to or shorter than a single period of each print drum 8 or 10. In addition, during a single period of the print drum 8 or 10, each rotatable member is caused to make a number of rotations which is an integral multiple of the number of rotations of the drum 8 or 10. For example, the ratio of the number of teeth of each drum drive gear 220 or 222 to that of each relay gear 226 or 230 is 4:1 while the ratio of the number of teeth of each timing pulley 224 or 228 to that of each adjustment pulley 40 or 42 is 1:1. In addition, the ratio of the number of teeth of the timing pulley 224 or 228 to that of the timing belt 232 is 1:4. These gear ratios allow the timing belt 232 to make one rotation during one rotation of the print drum 8 or 10. The ratio of the pitch circle diameter of the timing pulley 224 or 228 to that of each steer pulley 44 is 1:1.

If all the various ratios including the gear ratios are integral, the number of rotations of each rotatable member is an integral multiple of the number of rotations of the print drum 8 or 10 for a single period of the drum 8 or 10. This is successful to obviate a phase difference (deviation in synchronism) between the print drums 8 and 10 and therefore an offset ghost. This will be described more specifically with reference to FIGS. 9 and 10.

Figure 9:
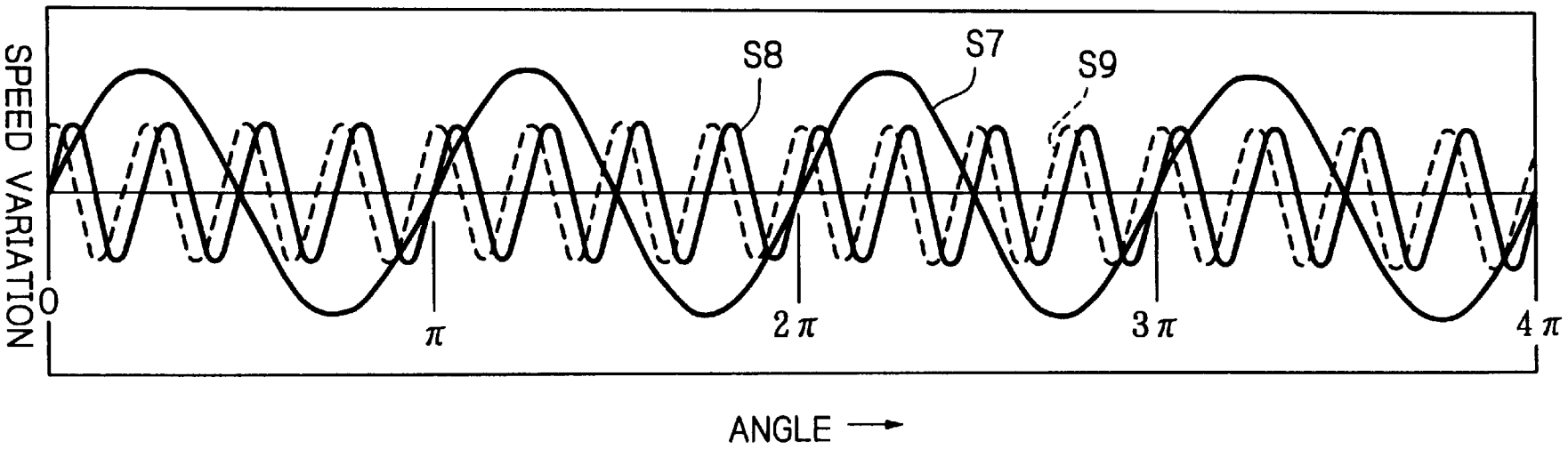
FIG. 9 is a waveform diagram showing speeds varying due to the eccentricity of, e.g., adjustment pulleys included in the first embodiment.

Assume that the drum drive gears 220 and 222 and pulleys 40 and 42 are eccentric, and that the ratio of the number of teeth of each drum drive gear 220 or 222 to that of each pulley 40 or 42 is 4:1. Then, the speed of the drum drive gear 220 and that of the pulley 40 vary, as shown in FIG. 9. The other drive pulley 222 and the other pulley 42 respectively vary in speed in the same manner as the drum drive gear 220 and pulley 40 although not shown specifically.

In FIG. 9, a solid waveform S7 indicates the speed variation of the drum drive gear 220. A solid waveform S8 indicates the speed variation of the adjustment pulley 40; the origin of the speed variation is shown as coinciding with the origin of the speed variation of the drum drive gear 220. Further, a dashed waveform S9 indicates the speed variation of the adjustment pulley 40 occurring when the eccentric position of the drum drive gear 220 and that of the adjustment pulley 40 are different from each other. As shown, so long as the eccentric positions are coincident, just four periods of the adjustment pulley 40 or 42 occur in a single period of the drum drive gear 220 or 222.

Figure 10:
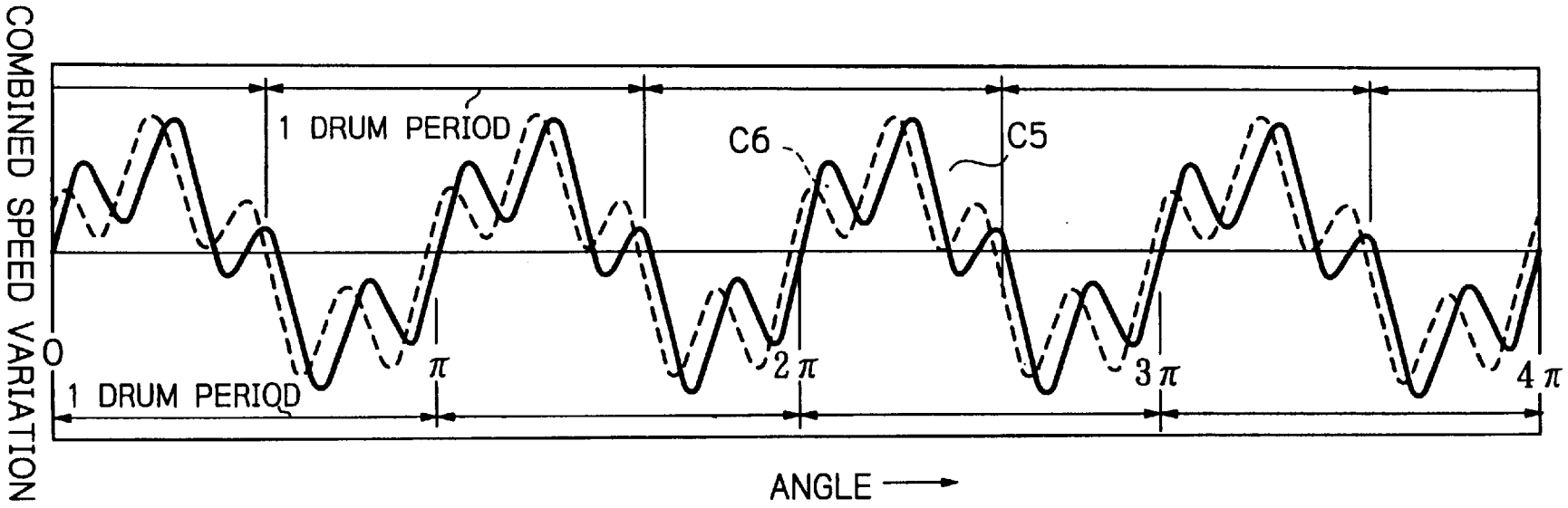
FIG. 10 is a waveform diagram showing the combined variations of the speeds shown in FIG. 9.

FIG. 10 shows a solid waveform C5 representative of the combined speed variation of the waveforms S7 and S8 of FIG. 9, and a dashed waveform C6 representative of the combined speed variation of the waveforms 75 and S9 of FIG. 9. As shown, wherever a drum period may begin, the waveforms C5 and C6 each vary in an identical manner in all drum periods. That is, the print drums 8 and 10 deviate from each other in the same manner in all periods and prevent an offset ghost from appearing. More specifically, even when the timing belt 232 involves an eccentric component, an offset ghost does not occur so long as the ratio of the period of the timing belt 232 to that of the print drum 8 or 10 is 1:1. This is because all the other rotatable members have integral ratios to the print drums 8 and 10; the integral multiples cancel the eccentric components of the rotatable members in a single period of the print drums 8 and 10.

An offset ghost occurs once for a single rotation of the print drums 8 and 10. While a change in speed may occur after the leading edge of the paper P has moved away from a print position assigned to the second color, the change is absorbed by the warp of the paper P being conveyed. It follows that if the print drum 10 is accurately synchronous to the print drum 8 when the paper P enters a nip between the drum 10 and the press roller 16, an offset ghost does not appear.

Assume that while the paper P is being conveyed over the nip between the print drum 8 and the press roller 12 and the nip between the print drum 10 and the press roller 16, the print drums 8 and 10 are brought out of synchronism. Then, the warp successfully absorbs the resulting phase difference. After the trailing edge of the paper P has moved away from the nip between the print drum 10 and the press roller 16, the above phase difference does not matter at all.

The above relation also holds with a tricolor or a tetracolor printer. The crux is that an upstream and a downstream print drums be accurately synchronized to each other when a paper arrives at the downstream drum. The numbers of rotations which are the integral multiples of the number of rotations the print drums 8 and 10 are a specific example capable of maintaining the drums 8 and 10 in the above relation.

2nd Embodiment

Figure 11:
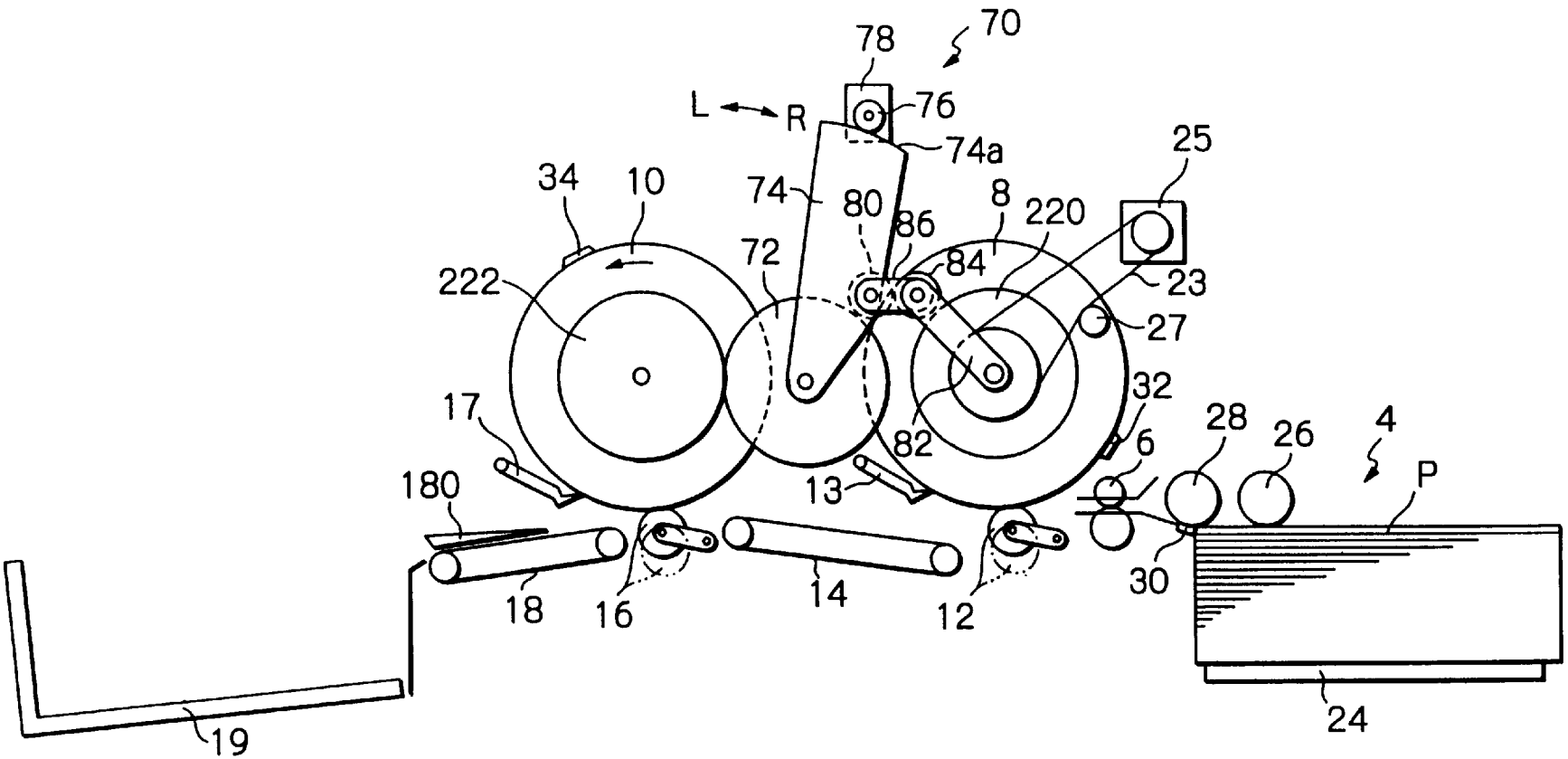
FIG. 11 is a front view showing a second embodiment of the present invention.
Figure 12:
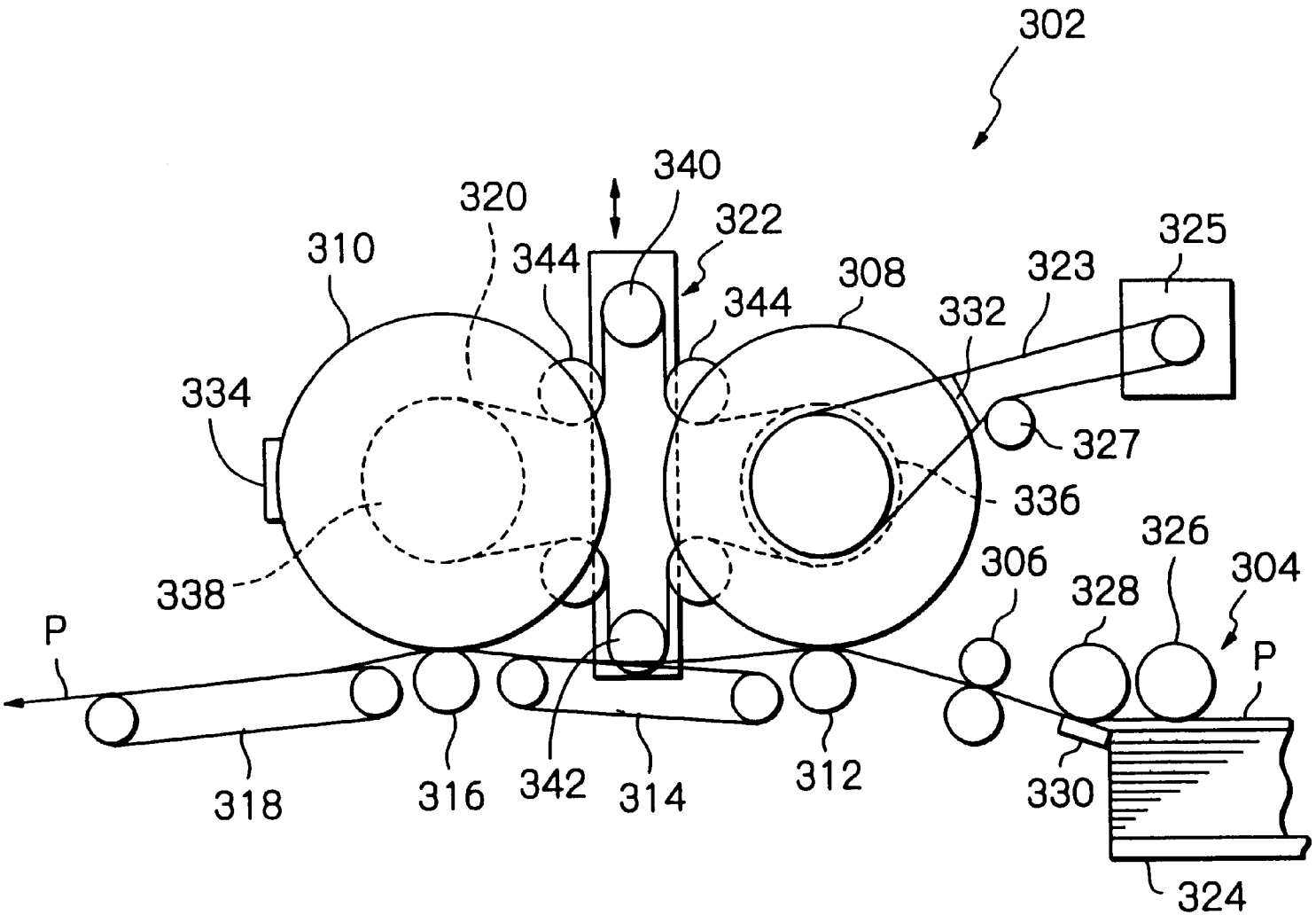
FIG. 12 is a front view showing a third embodiment of the present invention.

FIG. 11 shows an alternative embodiment of the printer in accordance with the present invention. In FIG. 11, structural elements identical with the structural elements of the first embodiment are designated by identical reference numerals and will not be described specifically in order to avoid redundancy. As shown, the printer includes phase adjusting means 70.

The phase adjusting means 70 includes a gear 72 meshing with a drum drive gear 222. The gear 72 has a shaft on which a sector gear 74 is rotatably mounted. A motor 76 has an output shaft on which a drive gear 76 is mounted. The drive gear 76 is held in mesh with a gear portion 74*a* included in the sector gear 74. A small diameter gear 80 is supported by the major part of the sector gear 74 and held in mesh with the gear 72. A drum drive gear 220 has a shaft supporting one end of an arm 82 such that the arm 82 is angularly movable. A small diameter gear 84 is rotatably supported by the other end of the arm 82 and held in mesh with the drum drive gear 220 and small diameter gear 80. An arm 86 connects the small diameter gears 80 and 84. The motor 78 causes the sector gear 74 to move in either one of directions indicates by arrows R and L, thereby correcting color deviation between the print drums 8 and 10.

In the illustrative embodiment, the drum drive gears 220 and 222, gear 72 and small diameter gears 80 and 84 are rotatable members for causing the two print drums 8 and 10 to rotate in synchronism with each other.

A single period of each of the above rotatable members is selected to be equal to or shorter than a single period of the print drums 8 and 10, as in the previous embodiment. In addition, during a single period of the print drums 8 and 10, each rotatable member is caused to make rotations the number of which is an integral multiple of the number of rotations of the drums 8 and 10. For example, the ratio of the number of teeth of the drum drive gears 220 and 222 to that of the gear 72 is 1:1 while the ratio of the number of teeth of the drum drive gear 220 or 222 to that of the small diameter gears 80 and 82 is 4:1. Such integral ratios or integral multiples are successful to cancel the eccentricity component of each rotatable member, thereby obviating an offset ghost.

3rd Embodiment

Referring to FIGS. 12 through 16, another alternative embodiment of the printer in accordance with the present invention is shown. As shown, the printer, generally 302, includes paper feeding means 304 for feeding the papers P to a registration roller pair 306 one by one. Two print drums 308 and 310 are spaced from each other in the direction of paper conveyance. A press roller or pressing member 312 is movable into and out of contact with the upstream print drum 308 by being driven by a moving mechanism not shown. Suction belt type intermediate conveying means 314 conveys the paper P between the print drums 308 and 310. Another press roller or pressing member 316 is movable into and out of contact with the downstream print drum 310 by being driven by a moving mechanism not shown. Out let conveying means 318 conveys the paper P separated from the print drum 310 to a print tray not shown. A timing belt 320 allows the print drums 308 and 310to be driven in synchronism with each other. Phase adjusting means 322 adjusts the phases of the print drums 308 and 310.

A main motor 325 causes the upstream print drum 308 to rotate via a main drive belt 323. The rotation of the upstream print drum 308 is transferred to the downstream print drum 310 by the timing belt 320. A pulley 327 applies an adequate degree of tension to the main drive belt 323.

In the paper feeding means 304, a tray 324 is loaded with a stack of papers P and intermittently raised by a motor not shown. A pickup roller 326, a separator roller 328 and separator pad 330 cooperate to feed the top paper P from the tray 324 toward the registration roller pair 306 while separating it from the underlying papers. The registration roller pair 306 corrects, e.g., the skew of the paper P and conveys it toward the print drum 308 at such a timing that the leading edge of the paper P meets the leading edge of an image formed on the print drum 308.

At the above timing, the press roller 312 is pressed against the print drum 308. Ink feeding means arranged within the print drum 308 feeds ink of the first color to the inner periphery of the print drum 308. The press roller 312 therefore causes the ink to penetrate through the print drum 308 and the perforations of a master, not shown, wrapped around the drum 308 to the paper P. As a result, an image of a first color is printed on the paper P. It is to be noted that the press roller 312 is intermittently pressed against the print drum 308 so as not to interfere with a damper 332 mounted on the outer circumference of the drum 308.

Separating means, not shown, separates the paper P carrying the image of the first color thereon from the print drum 308. The intermediate conveying means 314 conveys the separated paper P while a suction fan, not shown, retains the paper P on the conveying means 314 by suction. The linear velocity of the conveying means 314 is selected to be higher than the linear velocity of the paper P by preselected times. The conveying means 314 conveys the paper P to a nip between the downstream print drum 310 and the press roller 316.

Ink feeding means, not shown, is also arranged within the downstream print drum 310 and feeds ink of a second color to the inner periphery of the drum 310. Therefore, when the press roller 316 is pressed against the print drum 310 with the intermediary of the paper P, it causes the above ink to penetrate through the print drum 310 and a master, not shown, wrapped around the drum 310 to the paper P. Consequently, an image of the second color is printed on the paper P over the image of the first color existing on the paper P. The press roller 316 is intermittently pressed against the print drum 310 so as not to interfere with a damper 334 mounted on the outer circumference of the drum 310.

Separating means, not shown, separates the paper P carrying the composite image of the first and second colors thereon from the print drum 310. The out let conveying means 318 conveys the separated paper P while a suction fan, not shown, retains the paper P on the conveying means 318 by suction. Finally, the paper or print P is driven out to a print tray not shown.

Two toothed drum drive pulleys or timing pulleys 336 and 338 are respectively mounted on the shafts 350 and 352 of the print drums 308 and 310 such that the print drums 308 and 310 are replaceable. A timing belt 320 is passed over the drum drive pulleys 336 and 338. The phase adjusting means 322 includes two adjustment pulleys or timing pulleys 340 and 342. Four steer pulleys 344 are fixed in place between the adjustment pulleys 340 and 342 and the drum drive pulleys 336 and 338. The steer pulleys 344 allow phase adjustment based on the up-and-down movement of the phase adjusting means 322 to be efficiently effected within a short distance. In the illustrative embodiment, too, the steer pulleys 344 serve as tension pulleys as the same time.

Figure 13:
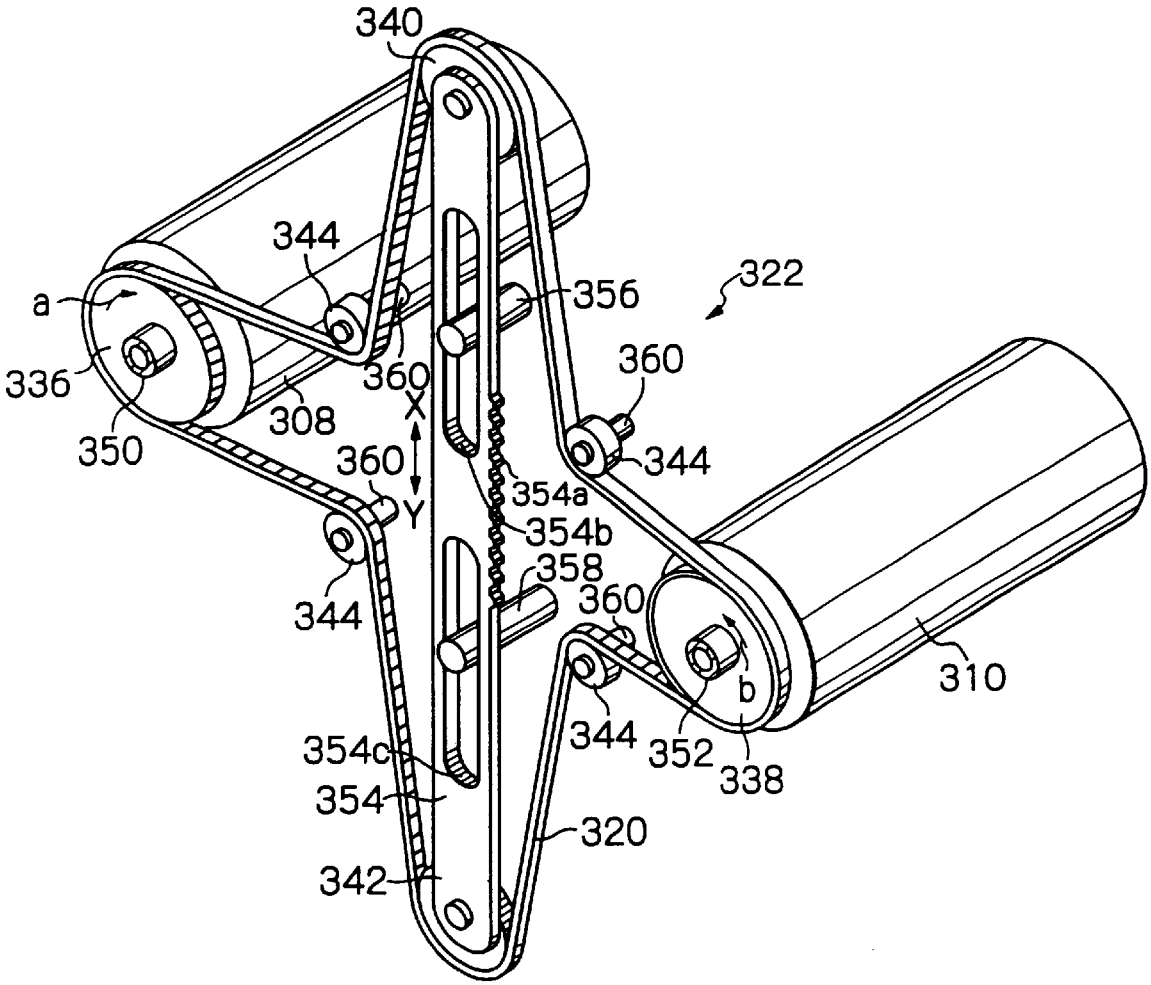
FIG. 13 is an isometric view showing phase adjusting means included in the third embodiment.

As shown in FIG. 13, the phase adjusting means 322 includes a frame 354 elongate in the up-and-down direction. The adjustment pulleys 340 and 342 are respectively rotatably mounted on the upper and lower end portions of the frame 354. A pinion, not shown, is held in mesh with a rack 354*a* forming part of the frame 354 and is driven by a motor not shown. Elongate slots 354*b* and 354*c* are respectively formed in the upper half and lower half of the frame 354, and each extends in the up-and-down direction. Guide pins 356 and 358 are affixed to the side walls of the printer body and received in the slots 354*a* and 354*b*, respectively. The frame 354 is movable up and down while being guided by the guide pins 356 and 358 and guides, not shown, also fixed to the above side walls.

The steer pulleys 344, implemented as plain pulleys, each are rotatably mounted on a respective shaft 360 fixed to the side walls of the printer body. The steer pulleys 344 are positioned between the adjustment pulleys 340 and 342 and the drum drive pulleys 336 and 338 in such a manner as to squeeze the timing belt 320 and held in contact with the rear of the timing belt 320.

When the motor drives the pinion in order to move the frame 354 upward, as indicated by an arrow X, the frame 354 raises the pulleys adjustment 340 and 342 and thereby causes the print drums 308 and 310 to respectively rotate in directions a and b. As a result, the phases of the print drums 308 and 310 are varied to correct color deviation. The motor may be driven in the opposite direction to move the frame 354 downward, as indicated by an arrow Y, thereby adjusting the above phases in the opposite direction.

The drum drive pulleys 336 and 338 have the same number of teeth which is greater than the number of teeth of the adjustment pulleys 340 and 342 of the phase adjusting means 322. The adjustment pulleys 340 and 342 have the same number of teeth.

In the illustrative embodiment, the adjustment pulleys 340 and 342 each have a number of teeth which is 1/integer of the number of teeth of the drum drive pulleys 336 and 338. Stated another way, the number of teeth of the drum drive pulleys 336 and 338 is an integral multiple of the number of teeth of the adjustment pulleys 340 and 342. For example, the drum drive pulleys 336 and 338 each have 144 teeth while the adjustment pulleys 340 and 342 each have thirty-six teeth. With this relation, it is possible to obviate a phase difference (deviation in synchronism) between the print drums 308 and 310 and therefore an offset ghost even if the adjustment pulleys 340 and 342 are eccentric. This will be described more specifically with reference to FIGS. 14 and 15.

Figure 14:
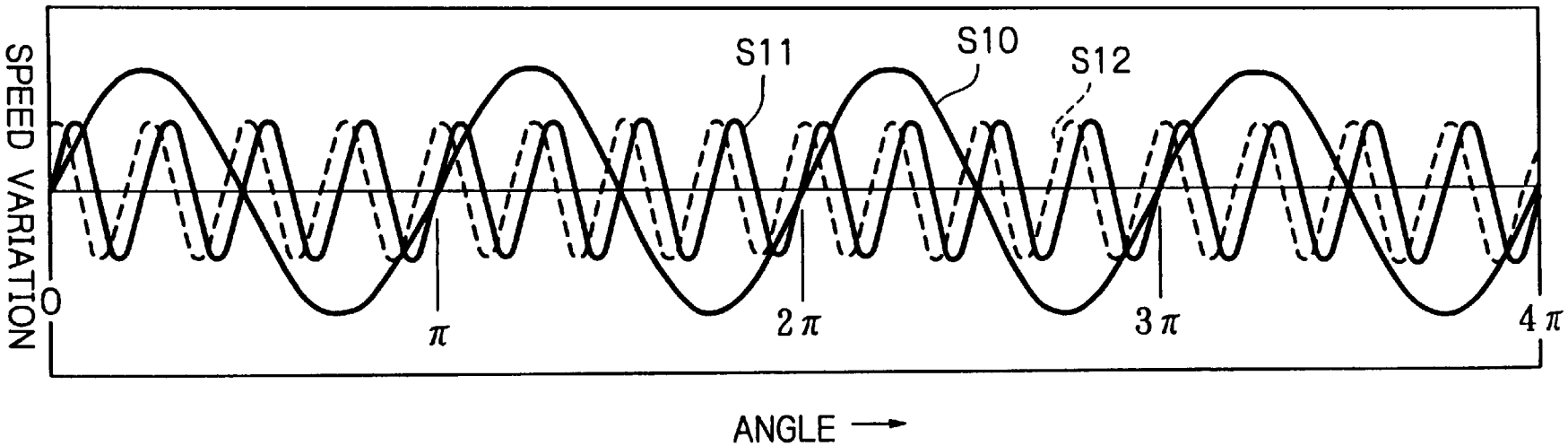
FIG. 14 is a waveform diagram showing speeds varying due to the eccentricity of, e.g., adjustment pulleys included in the third embodiment.

Assume that the drive pulleys 336 and 338 and adjustment pulleys 340 and 342 are eccentric, and that the ratio of the number of teeth of each drum drive pulley 336 or 338 to that of each adjustment pulley 340 or 342 is 4:1. Then, the speed of the drum drive pulley 336 and that of the adjustment pulley 340 vary, as shown in FIG. 14. The other drum drive pulley 338 and the other adjustment pulley 342 respectively vary in speed in the same manner as the pulleys 336 and 340 although not shown specifically.

In FIG. 14, a solid waveform S10 indicates the speed variation of the drum drive pulley 336. A solid waveform S11 indicates the speed variation of the adjustment pulley 340; the origin of the speed variation is shown as coinciding with the origin of the speed variation of the drum drive pulley 336 for the sake of illustration. Further, a dashed waveform S12 indicates the speed variation of the adjustment pulley 340 occurring when the eccentric position of the drum drive pulley 336 and that of the pulley 340 are different from each other. As shown, so long as the eccentric positions are coincident, just four periods of the adjustment pulley 340 or 342 occur in a single period of the drum drive pulley 336 or 338.

Figure 15:
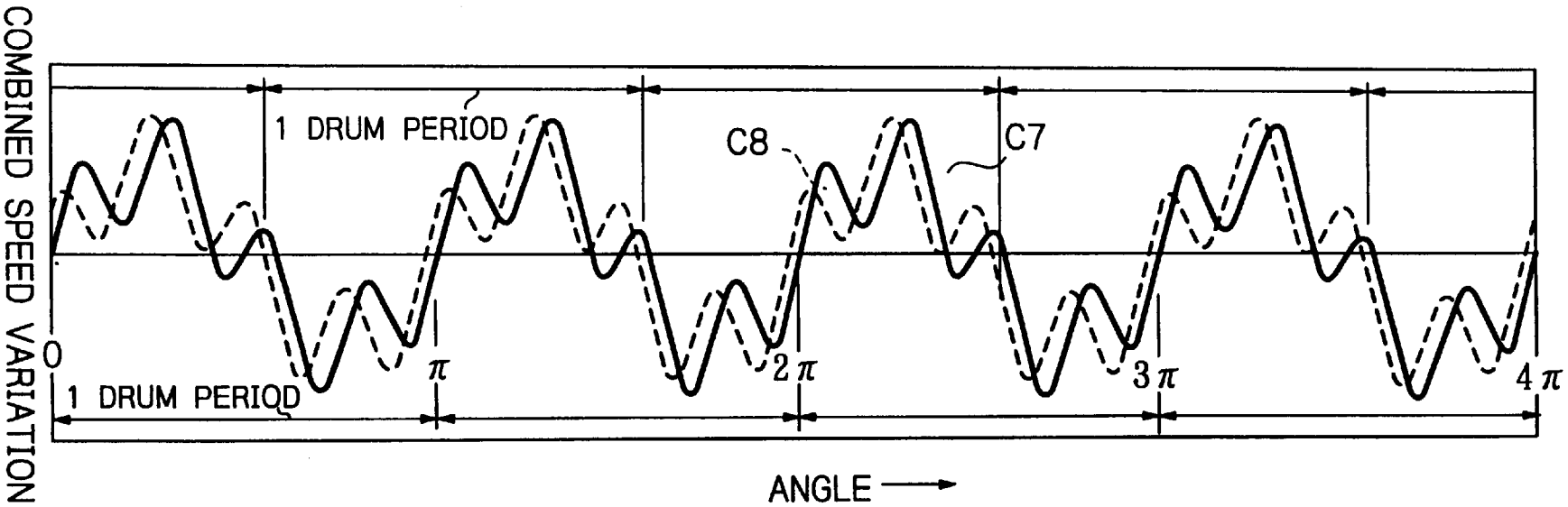
FIG. 15 is a wave form diagram showing the combined variations of the speeds shown in FIG. 14.

FIG. 15 shows a solid waveform C7 representative of the combined speed variation of the waveforms S10 and S11 of FIG. 14, and a dashed waveform C8 representative of the combined speed variation of the waveforms 710 and S12 of FIG. 14. As shown, wherever a drum period may begin, the same waveform C5 and C6 each vary in the same manner in all drum periods. That is, the print drums 8 and 10 deviate from each other in the same manner in all drum periods and prevent an offset ghost from appearing.

While the illustrative embodiment includes the steer pulleys 344, it is also capable of obviating an offset ghost with the above 1/integer configuration even if the steer pulleys 344 are absent.

Figure 16:
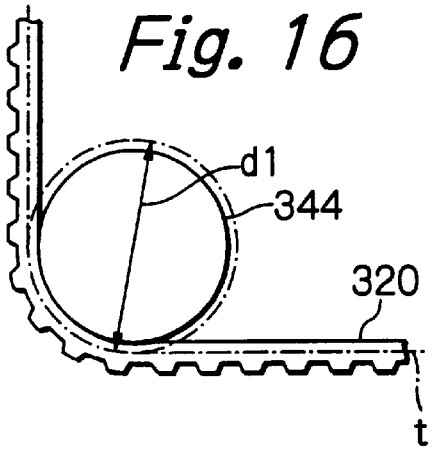
FIG. 16 is a fragmentary view showing the pitch circle diameter of a steer pulley included in the third embodiment.

When the steer pulleys 344 are present, the pitch circle diameter of each steer pulley 344 may also be selected to be 1/integer of the pitch circle diameter of each drum drive pulley 336 or 338. Stated another way, the pitch circle diameter of each drum drive pulley 336 or 338 may be an integral multiple of the pitch circle diameter of each steer pulley 344. For example, the ratio of the pitch circle diameter of each drum drive pulley 336 or 338 to that of each steer pulley 344 may be 5:1. The steer pulleys 344 have the same pitch circle diameter. In this case, as shown in FIG. 16, the steer pulleys 344 each have a pitch circle diameter d1 extending to the pitch line, or core line position, t of the timing belt 320.

The illustrative embodiment is a solution to the problem that the eccentricity of the steer pulleys 44 is also causative of a phase difference between the print drums 308 and 310. Experiments showed that this embodiment could cope with an offset ghost at a higher level.

Assume that the adjustment pulleys 340 and 342 of the phase adjusting means 322 are not eccentric, but the steer pulleys 344 are eccentric. Then, an offset ghost can be control led only if the pitch circle diameter of the steer pulleys 344 is selected to be 1/integer of the pitch circle diameter of the drum drive pulleys 336 and 338.

It is to be noted that 144 teeth and thirty-six teeth respectively assigned to the drum drive pulleys 336 and 338 and adjustment pulleys 340 and 342, as mentioned earlier, area preferable example of the ratio of 4:1. When the integral ratio of 4:1, 3: 1 or 5:1 is selected in consideration of balance between accuracy and cost, the drum drive pulleys 336 and 338 should preferably have 108 to 180 teeth.

As shown in FIG. 13, the print drums 308 and 310 are connected to each other by an extremely simple mechanism not using precision gears. Specifically, the timing belt 320 is passed over the rotatable members implemented as the drum drive pulleys 336 and 338, adjustment pulleys 340 and 342, and steer pulleys 344. Therefore, even if the rotatable members are eccentric, a phase difference between the print drums 308 and 310 does not occur so long as the pitch circle diameters of the rotatable members and that of the drum drive pulleys 336 and 338 are held in the 1/integer relation. However, the ratio of the number of teeth of the timing belt 320 to that of the drum drive pulleys 336 and 338 cannot be 1:1 due to the extremely simple configuration, so that only the eccentricity of the timing belt 320 itself may bring about a phase difference.

The above phase difference ascribable to the timing belt 320 effects the pitch circle diameter of the downstream drum drive pulley 338. A deviation on the print drum 310 expected to form an image thereon is increased by the ratio of the diameter of the print drum 310 to the pitch circle diameter of the drum drive pulley 338. It follows that an offset ghost can be reduced more positively as the pitch circle diameter of the drum drive pulleys 336 and 338 increases. However, because pulleys as large as the print drums 308 and 310 increase the cost, the pitch circle diameter of the drum drive pulleys 336 and 338 must be selected in consideration of balance between accuracy and cost.

Further, the accuracy of the timing belt 320 is the potential cause of an offset ghost, as stated above. The timing belt 320 should therefore be as accurate as possible and should consequently be provided with a belt pitch of 3 mm or less. On the other hand, considering the fact that the timing belt 320 should be rigid enough to withstand heavy loads in order to implement highly accurate drive transmission, the belt pitch should not be 2 mm or less. Consequently, the optimal belt pitch is 3 mm. It follows that when the ratio of the number of teeth of the drum drive pulleys 336 and 338 to that of the adjustment pulleys 340 and 342 is selected to be 4:1, 3:1 or 5:1, the timing belt 320 should preferably have a pitch of 3 mm while the drum drive pulleys 336 and 338 should preferably have 108 to 180 teeth each.

4th Embodiment

Figure 17:
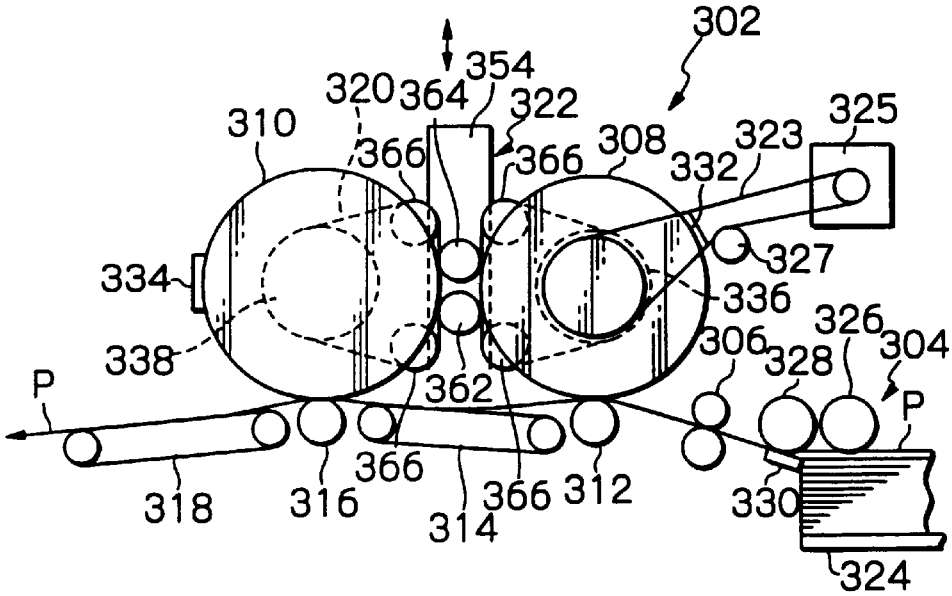
FIG. 17 is a front view showing a fourth embodiment of the present invention.
Figure 18:
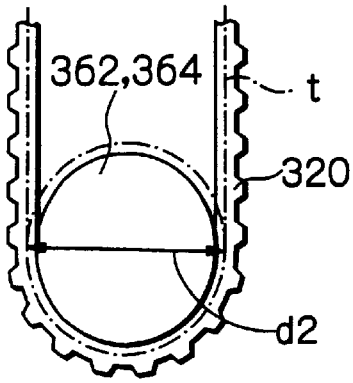
FIG. 18 is a fragmentary view showing the pitch circle diameter of an adjustment pulley included in the fourth embodiment.

FIGS. 17 and 18 show still another alternative embodiment of the printer in accordance with the present invention. In FIGS. 17 and 18, structural elements identical with the structural elements shown in FIGS. 12 through 16 are designated by identical reference numerals and will not be described specifically in order to avoid redundancy. As shown, the phase adjusting means 322 includes a frame 354 on which adjustment pulleys or plain pulleys 362 and 364 are mounted. The adjustment pulleys 362 and 364 are positioned close to each other and contact the rear of the timing belt 320. Four toothed steer pulleys 366 are fixed in place between the adjustment pulleys 362 and 364 and the drum drive pulleys 336 and 338 and held in mesh with the timing belt 320.

In the illustrative embodiment, to obviate an offset ghost, the adjustment pulleys 362 and 364 are provided with a pitch circle diameter that is 1/integer of the pitch circle diameter of the drum drive pulleys 336 and 338. For example, the ratio of the pitch circle diameter of the drum drive pulleys 336 and 338 to that of the adjustment pulleys 362 and 364 is selected to be 4:1. The drum drive pulleys 336 and 338 have the same pitch circle diameter which is greater than the pitch circle diameter of the adjustment pulleys 362 and 364. The adjustment pulleys.362 and 364 have the same pitch circle diameter. As shown in FIG. 18, the pulleys 362 and 364 each have a pitch circle diameter d2 extending to the pitch line t of the timing belt 320.

Again, even if the adjustment pulleys 362 and 364 are eccentric, a phase difference between the print drums 308 and 310 does not occur because of the 1/integer relation between the pitch circle diameters. This prevents an offset ghost from appearing.

While the illustrative embodiment also includes the steer pulleys 366, it is also capable of obviating an offset ghost with the above 1/integer configuration even if the steer pulleys 366 are absent.

When the steer pulleys 366 are present, the number of teeth of the steer pulleys 366 may also be selected to be 1/integer of the number of teeth of the drum drive pulleys 336 and 338. For example, the ratio of the number of teeth of the drum drive pulleys 336 and 338 to that of the steer pulleys 366 may be 4:1. In this case, the drum drive pulleys 336 and 338 have the same number of teeth which is greater than the number of teeth of the steer pulleys 366. The steer pulleys 366 have the same number of teeth.

The illustrative embodiment is a solution to the problem that the eccentricity of the steer pulleys 366 meshing with the timing belt 320 is also causative of a phase difference between the print drums 308 and 310. Experiments showed that this embodiment could cope with an offset ghost at a higher level.

Assume that the adjustment pulleys 362 and 364 of the phase adjusting means 322 are not eccentric, but the steer pulleys 366 are eccentric. Then, an offset ghost can be control led only if the number of teeth of the steer pulleys 366 is selected to 1/integer of the number of teeth of the drum drive pulleys 336 and 338.

While the third and fourth embodiments each move the frame 354 of the phase adjusting means 322 up and down with a rack and pinion scheme, the rack and pinion scheme may be replaced with a screw shaft and nut scheme.

In summary, it will be seen that the present invention provides a printer having various unprecedented advantages, as enumerated below.

(1) Rotatable members for interlocked drive are so arranged as to insure the synchronous rotation of an upstream and a downstream print drum when a paper arrives at the downstream print drum. This is successful to obviate an offset ghost even if the rotatable members are eccentric. The printer can therefore obviate an offset ghost despite the interlocked drive system without increasing the cost.

(2) Adjustment pulleys included in phase adjusting means each have teeth the number of which is 1/integer of the number of teeth of each drum drive pulley. Therefore, a phase difference between the print drums ascribable to the eccentricity of the adjustment pulleys is obviated. This allows the printer to reduce offset ghosts with a minimum of cost particular to an interlocked drive system using a timing belt.

(3) Steer pulleys each have a pitch circle diameter which is 1/integer of the pitch circle diameter of each drum drive pulley. This obviates a phase difference between the print drums ascribable to the eccentricity of the steer pulleys and thereby reduces offset ghosts at a high level. In addition, the low cost configuration of an interlocked drive system using a timing belt is also available.

(4) The adjustment pulleys (plain pulleys) each have a pitch circle diameter which is /1integer of the pitch circle diameter of each drum drive pulley. Therefore, a phase difference between the print drums ascribable to the eccentricity of the adjustment pulleys is obviated. This also allows the printer to reduce offset ghosts with a minimum of cost particular to an interlocked drive system using a timing belt.

(5) The steer pulleys (toothed pulleys) each have teeth the number of which is 1/integer of the number of teeth of each drum drive pulley. The printer therefore obviates a phase difference between the print drums ascribable to the eccentricity of the steer pulleys and thereby reduces offset ghosts at a high level. In addition, the low cost configuration of an interlocked drive system using a timing belt is also available.

Various modifications will become possible for those skilled in the art after receiving the teachings of the present disclosure without departing from the scope thereof.

What is claimed is:

1. A printer comprising:

a plurality of print drums spaced from each other in a direction in which a recording medium is conveyed; and a plurality of rotatable members comprising interlocking gears to drive said plurality of print drums in an interlocked fashion, wherein a rotating period of each of said interlocking gears is less than or equal to a rotating period of said plurality of print drums, and preselected so each interlocking gear makes, in a single period of the print drums, a number of rotations that is an integral multiple of a number of rotations of the print drums.

2. A printer as claimed in claim 1, further comprising a sector gear rotatably mounted on a shaft of one of said interlocking gears and supporting another one of said interlocking gears, a motor, and a drive gear mounted on an output shaft of the motor and meshing with the sector gear, wherein said motor causes said sector gear to change a position of one or more of said interlocking gears with respect to one or more other interlocking gears to prevent an upstream and a downstream print drum rotating synchronously to each other from being brought out of synchronism when the recording medium arrives at said downstream print drum.

* * * * *

UNITED STATES PATENT AND TRADEMARK OFFICE

CERTIFICATE OF CORRECTION

PATENT NO. : 6,715,412 B2
DATED : April 6, 2004
INVENTOR(S) : Keiichi Chiba et al.

It is certified that error appears in the above-identified patent and that said Letters Patent is hereby corrected as shown below:

Column 7,
Line 1, change “damper” to -- clamper --.

Column 10,
Line 15, change “Out let” to -- Outlet --,
Line 45, change “damper” to -- clamper --.

Column 11,
Line 1, change “damper” to -- clamper --

Column 12,
Line 63, change “control led” to -- controlled --.

Column 14,
Line 38, change “control led” to -- controlled --.

Signed and Sealed this

Twenty-eighth Day of December, 2004

JON W. DUDAS
*Director of the United States Patent and Trademark Office*